US005494144A

United States Patent [19]

Izawa

[11] Patent Number: 5,494,144

[45] Date of Patent: Feb. 27, 1996

[54] BILL HANDLING APPARATUS

[75] Inventor: Hikaru Izawa, Sagamihara, Japan

[73] Assignee: Japan Cash Machine Co., Ltd., Osaka, Japan

[21] Appl. No.: 331,659

[22] PCT Filed: Mar. 7, 1994

[86] PCT No.: PCT/JP94/00350

§ 371 Date: Dec. 12, 1994

§ 102(e) Date: Dec. 12, 1994

[87] PCT Pub. No.: WO94/20931

PCT Pub. Date: Sep. 15, 1994

[30] Foreign Application Priority Data

Mar. 8, 1993 [JP] Japan ..... 5-46794
Sep. 17, 1993 [JP] Japan ..... 5-50675

[51] Int. Cl.[6] ..... G07D 7/00

[52] U.S. Cl. ..... 194/203; 194/206

[58] Field of Search ..... 194/202, 203, 194/205, 206, 207, 344; 271/188, 209

[56] References Cited

U.S. PATENT DOCUMENTS 5,005,688 4/1991 Yukimoto et al. ..... 194/203
5,195,739 3/1993 Watabe ..... 194/203 X
5,259,490 11/1993 Gardellini ..... 194/207 X
5,325,952 7/1994 McGinley et al. ..... 194/203

FOREIGN PATENT DOCUMENTS 3810095 7/1989 Germany ..... 194/203
4123887 1/1992 Germany ..... 194/203
9116342 8/1984 Japan .
63-89181 6/1988 Japan .
0172173 7/1989 Japan ..... 271/209

*Primary Examiner*—Michael S. Huppert
*Assistant Examiner*—Scott L. Lowe
*Attorney, Agent, or Firm*—Bachman & LaPointe

[57] ABSTRACT

After passing in a deformed shape through bending device 28 provided between validator 24 and stacker 25, a bill 23 recovers its initial flat shape due to its own elasticity and provides a face which intersects blocking edges 31. After the bill 23 passes through the bending device 28, although a string attached to the bill 23 is extracted, it is impossible to return the bill to the passageway 27 to prevent any unauthorized extraction of the bill 23.

5 Claims, 10 Drawing Sheets

BILL HANDLING APPARATUS

FIELD OF THE INVENTION

The present invention relates, in general, to a bill handling apparatus, and more particularly, to a bill handling apparatus to prevent unauthorized extraction of bills which have been received in a stacker of the apparatus.

BACKGROUND OF THE TECHNOLOGY

For example, Japanese Utility Model Disclosure 63-89181 discloses a bill-extraction-proof device in a bill validator. As shown in FIGS. 18 and 19, in the bill-extraction-proof device, a bill is inserted from an inlet 7 into the space between a pair of side walls 2 and 3 of a frame 1, and is then carried by belts 11 and rollers 12 to further pass through the space between slant protrusions 9 and 10 formed on the frame 1 and a plate 5. Although the bill is slightly deformed when the bill passes through the slant protrusions 9 and 10, the deformation does not provide any obstacle in carrying the bill. If a person tries to withdraw the bill without authorization from the inlet 7 by pulling a string such as a fishing line connected to the bill after it passes through an outlet 8, the extraction is prevented due to engagement of the bill with the slant protrusions 9 and 10.

Disclosed in Japanese Utility Model Disclosure 4-36677 is another bill-extraction-proof device in which a stopper is rotatably provided to extend into the passageway of a bill validator and is rotated away from the passageway according to a control signal generated by the bill validator. This bill-extraction-proof device is advantageous in that extraction of bill is effectively prevented since the stopper is rotated away from the passageway only when a valid bill passes through the validator.

However, the bill-extraction-proof device shown in FIGS. 18 and 19 is disadvantageous in that the slant protrusions 9 and 10 cannot have their long extension length which may obstruct transportation of the bill by belts 11 due to engagement of the bill and long slant protrusions. Therefore, unauthorized extraction of the bill can be carried out by strongly pulling a fishing line connected to the bill or by pulling the line after inserting a thin flexible plate into the passageway.

Also, Japanese Utility Model Disclosure 4-36677 demonstrates an extraction-proof device in which, however, unauthorized extraction may be made by successively inserting two bills.

Therefore, an object of the present invention is to provide a bill handling apparatus with its simple construction strongly resistible against any unauthorized extraction of the bill.

SUMMARY OF THE INVENTION

A bill handling apparatus according to the present invention includes a casing provided with an inlet; validator means for judging authenticity of a bill inserted into the inlet of the casing; stacker means for accumulating the bill considered authentic by the validator means; and conveyor means for transporting the bill inserted into the inlet of the casing through the validator means to the stacker means. Bending means is provided between the validator means and the stacker means for gradually bending, into a V-shape, the bill discharged from the validator means with transportation of the bill.

In an embodiment of the instant invention, the bending means includes a guide plate for defining a passageway of the conveyor means, and guide portions integrally formed with and projecting from the guide plate. A pair of the guide portions are formed in both sides of the conveyor means. The guide portions have their inclining surfaces for guiding side edges of the bill toward a height different from the central portion of the bill and blocking edges formed at the rear end of the guide portions and extending to a position different from the passageway, the side edges of the bill being in parallel to a longitudinal central line of the bill.

The bill recovers the initial flat shape due to its own elasticity to form a face intersecting the blocking edges after passing through the guide portions in its deformed shape. At least a notch is formed in each slant surface or blocking edge of the guide. A plurality of pairs of the guide portions are formed into a stepped shape at both side portions of the conveyor means. The bending angle of the bill is in a range of 30 through 170 degrees and preferably in a range of 90 through 150 degrees. The bending means bends the bill into a curved shape with at least a small radius without any crease.

In another embodiment of the invention, the bending means includes central guide means for guiding the lengthwise central portion of the bill, guide portions for guiding side edges of the bill toward a height different from the central portion of the bill, and blocking edges formed at the rear end of the guide portions and extending to a position different from the passageway. The guide portions and the blocking edges are integrally formed with a guide plate which defines the passageway, and the blocking edges are formed into an inverted V-shape relative to the central guide means. The central guide means and blocking edges are protruded from the casing toward the stacker means so that the bill is deformed into an inverted V-shape by the bending means with transportation by the conveyor means. The central guide means has a belt and pulleys for guiding the bill. The bill carried by the validator means falls in the stacker means due to its own weight.

After carried through the validator means by the conveyor, the bill is extremely deformed by the bending means relative to the passageway when it passes through the bending means toward the stacker means, and is then forwarded to the stacker means. Subsequently, the bill recovers its initial flat shape due to its own elasticity. Therefore, after the bill is received in the stacker means, an attempt of pulling a string or the like attached to the bill fails to withdraw the bill because the blocking edges inhibit returning movement of the bill due to contact of the blocking edges and bill to thereby prevent any unauthorized extraction of the bill.

BEST MODES FOR EMBODIMENT OF THE INVENTION

Now, embodiments of the bill handling apparatus according to the present invention will be described referring to FIGS. 1 through 17.

Figure 1:
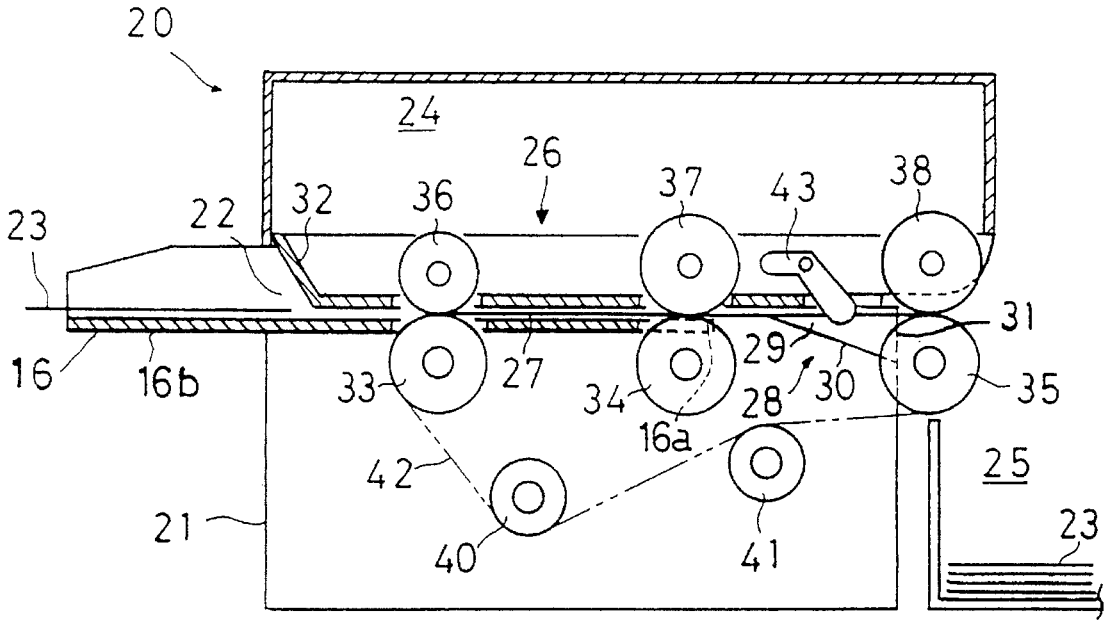
FIG. 1 is a sectional view of a bill handling apparatus according to the present invention applied to validator means.
Figure 2:
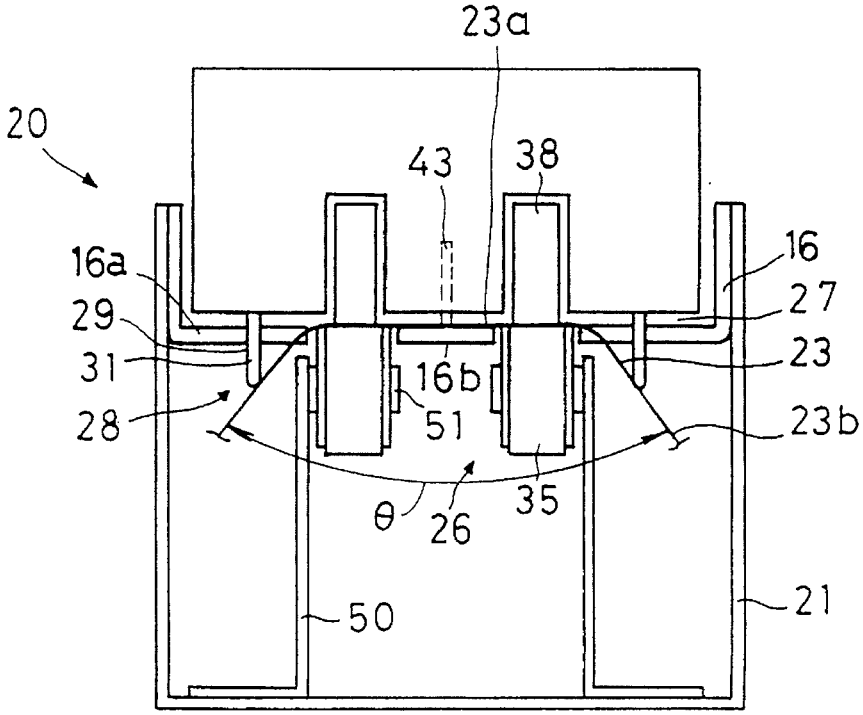
FIG. 2 is a rear view of FIG. 1.
Figure 3:
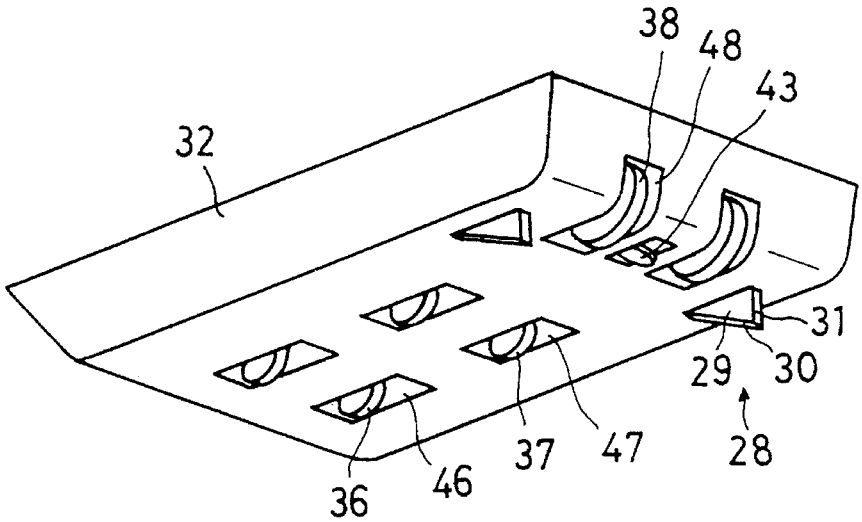
FIG. 3 is a perspective view of FIG. 1 with a casing removed.

As shown in FIG. 1, the bill handling apparatus 20 comprises a casing 21 formed with an inlet 22, validator means 24 for judging authenticity of a bill 23 which is inserted from the inlet 22 of the casing 21, stacker means 25 for accumulating the bill 23 considered authentic by the validator means 24, and a conveyor 26 for carrying the bill inserted from the inlet 22 of the casing 21 through the validator means 24 toward the stacker means 25. The validator 24 has a magnetic detector, optical detectors and optical dimensions measuring devices not shown because well known by for example Japanese Utility Model Disclosure No. 4-36677. The box-shaped stacker means 25 is disposed adjacent to the rear portion of the validator means 24 so that the bill 23 discharged from the validator means 24 falls in the stacker means 25 due to its own weight. The conveyor 26 includes a belt-pulley driving device (not shown) provided with three pairs of pulleys 33–35 to drive a belt 42, and rollers 36–38 respectively arranged opposite to the pulleys 33–35. The belt 42 is wound around the pulleys 33–35, 40 and 41. As shown in FIG. 2, the pulleys 35 are supported by shafts 51 which are attached to frames 50 secured to the casing 21. The bill 23 is carried along a passageway 27 between guide plate 32 and support plate 16 in the condition of the lengthwise central portion 23*a* of the bill 23 sandwiched between the belt 42 and the rollers 36–38. Support plate 16 includes an inner end 16*a* and a bottom surface 16*b*.

Bending means 28 is provided at the rear end of the conveyor 26 between the validator means 24 and the stacker means 25. In the embodiment shown in FIG. 3, the bending means 28 is integrally formed with a guide plate 32 which defines the passageway 27 of the conveyor 26, and has a pair of guide portions 29 which are formed in triangle to project from the guide plate 32. The inner end 16*a* of support plate 16 terminates before guide portions 29 so that each guide portion 29 extends downward from the guide plate 32 below bottom surface 16*b* of support plate 16. A pair of the guide portions 29 are formed in the conveyor 26, one on each side. The guide plate 32 is formed into one piece integrally with the bending means 28 from plastic materials such as polyacetal, ABS, polyamide (Nylon) and polycarbonate to provide an upper wall of the passageway 27 of the conveyor 26. The guide plate 32 is bent upward at the front and rear portions and formed with pairs of openings 46–48 to receive the rollers 36–38 respectively. Each guide portion 29 has a slant surface 30 for directing side edges 23*b* of the bill 23 downwardly into the curved condition so that the side edges 23*b* in parallel to the lengthwise central portion 23*a* of the bill 23 reach a height different from the level of the central portion 23*a* of the bill 23 and are deformed below bottom surface 16*b* of guide support plate 16; and a blocking edge 31 provided at the rear ends of the guide portions 29 to extend downwardly from the passageway 27. With transportation of the bill 23 by the conveyor 26, the side edges 23*b* are extremely deformed away from the passageway 23 so that a desirable angle of the slant surfaces 30 for guiding the side edges 23*b* of the bill 23 is in a range of 10 through 45 degrees and the blocking edges 31 extend downward from the guide plate 32. Provided in parallel to the bending means 28 are bent levers 43 which are rotated when the bill 23 passes therethrough to generate a bill-reception signal by a bend-sensor not shown.

The box-shaped stacker means 25 is provided adjacent to the rear portion of the validator means 24, and the conveyor 26 extends over the stacker means 25 out of the casing 21 so that the bill 23 discharged from the validator 24, falls in the stacker means 25 due to its own weight. Then, the bill 23 recovers its initial flat shape due to its own elasticity to form a face which intersects the blocking edges 31.

After inserted from the inlet 22, the bill 23 is carried by the conveyor 26 through the validator means 24 to the stacker means 25 via the bending means 28 in which the bill 23 is gradually and extremely bent by the guide portions 29 into an inverted-V shape relative to the passageway 27 and then is carried to the stacker means 25. The bill 23 is deformed by the bending means 28 into the curved shape at least with a small radius without creases or folds and is discharged from the validator means 24. The bent angle $\Theta$ of the bill 23 is in a range of 30 to 170 degrees, preferably in a range of 90 through 150 degrees. After that, the bill recovers its initial flat shape. Therefore, it is impossible to get the bill 23 back to the passageway 27 by pulling a string or the like attached to the bill 23 because of contact of the bill 23 with the blocking edges 31 thereby preventing any unauthorized extraction of the bill 23. In addition, due to the molding manufacture of the guide plate 32 and the guide portions 29 into a unit from plastic resin, it is easy to make the bending means 28, reducing the number of parts, saving cost in manufacture and realizing weight reduction of the apparatus.

Figure 4:
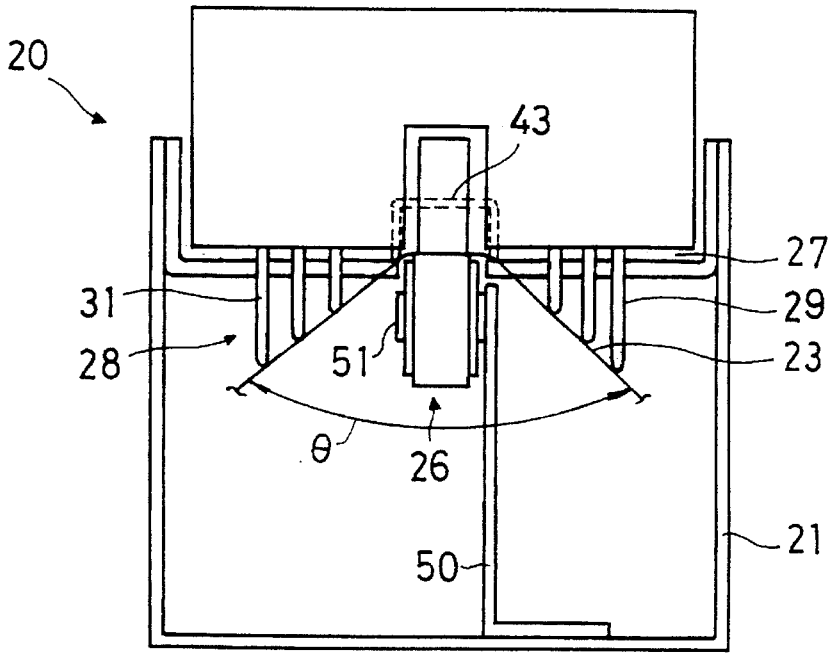
FIG. 4 is a rear view showing another embodiment of the present invention.
Figure 5:
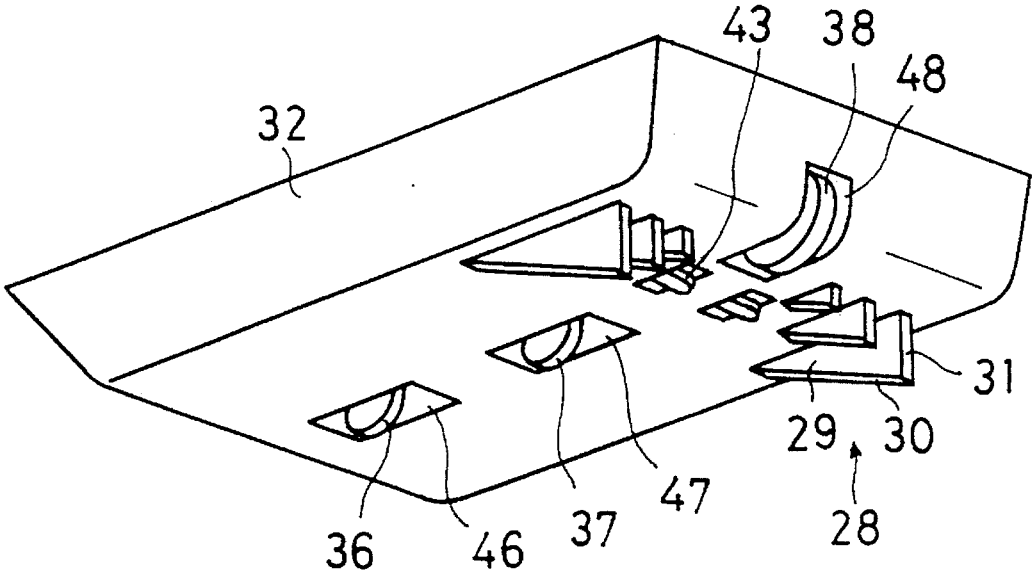
FIG. 5 is a perspective view of FIG. 4 with a casing removed.
Figure 6:
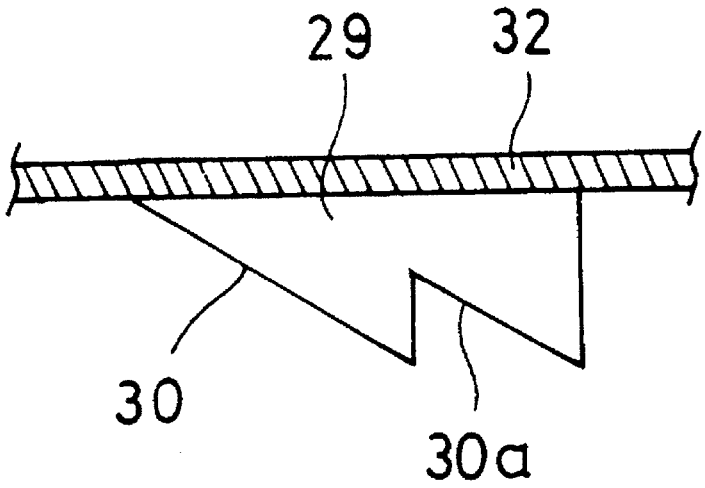
FIG. 6 is a side view showing an embodiment of guide portions according to the present invention.
Figure 7:
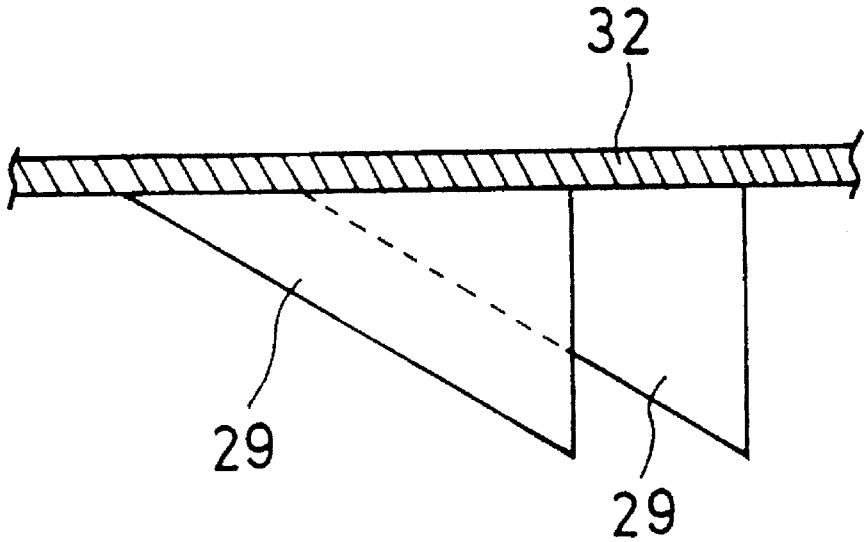
FIG. 7 is a side view showing another embodiment of guide portions according to the present invention.

The embodiment of the present invention shown in FIGS. 1 and 2 may be varied as shown in FIGS. 4 and 5. Specifically, as shown in FIGS. 4 and 5, several pairs of guide portions 29 can be formed into stepped shape in both sides of the conveyor 26. As shown in FIG. 6, a notch 30*a* formed in each slant surface 30 serves to prevent an unauthorized extraction not only after the bill 23 is maintained in the stacker means 25, but also while the bill 23 is passing through the bending means 28. The notches 30*a* may be formed on the blocking edges 31. As an alternative shown in FIG. 7, without the notches 30*a* on the guide portions 29, a plurality of the guide portions 29 may be arranged in the shifted positions along the travel direction of the bill 23. The conveyor 26 may comprise a plurality of pulleys and belts. In the foregoing example, the upper wall of the passageway 27 in the conveyor 26 is formed by the guide plate 32, however, instead, a bottom wall of the passageway 27 may be formed to bend the bill 23 into V-shape.

Figure 8:
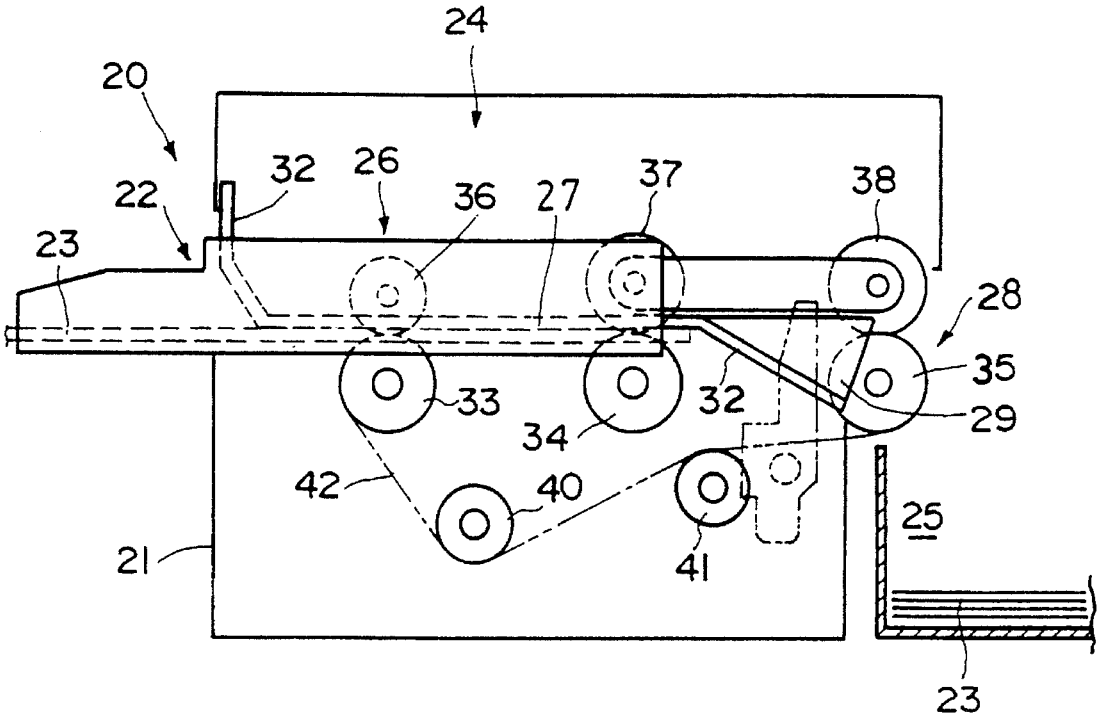
FIG. 8 is a sectional view showing a third embodiment according to the present invention.
Figure 9:
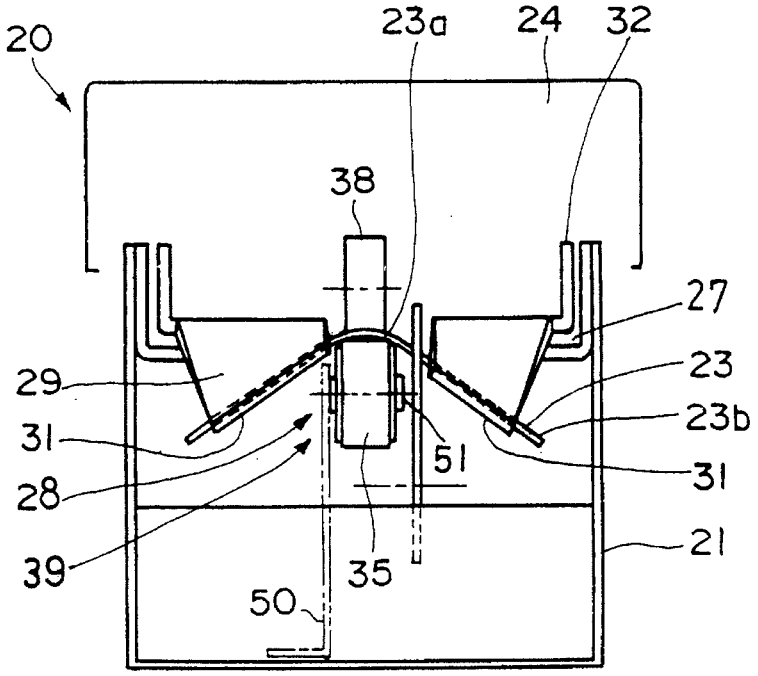
FIG. 9 is a rear view of FIG. 8.
Figure 10:
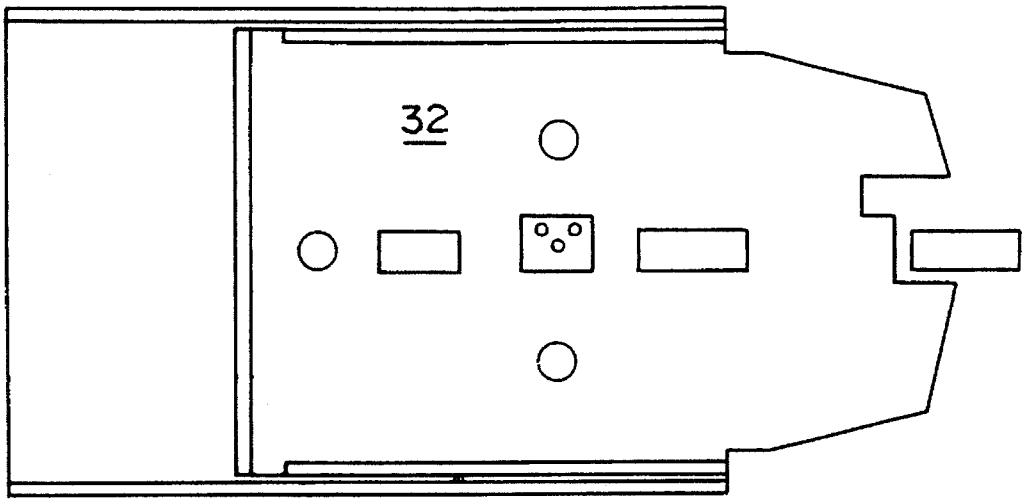
FIG. 10 is a top view of FIG. 8 with the validator means removed.
Figure 11:
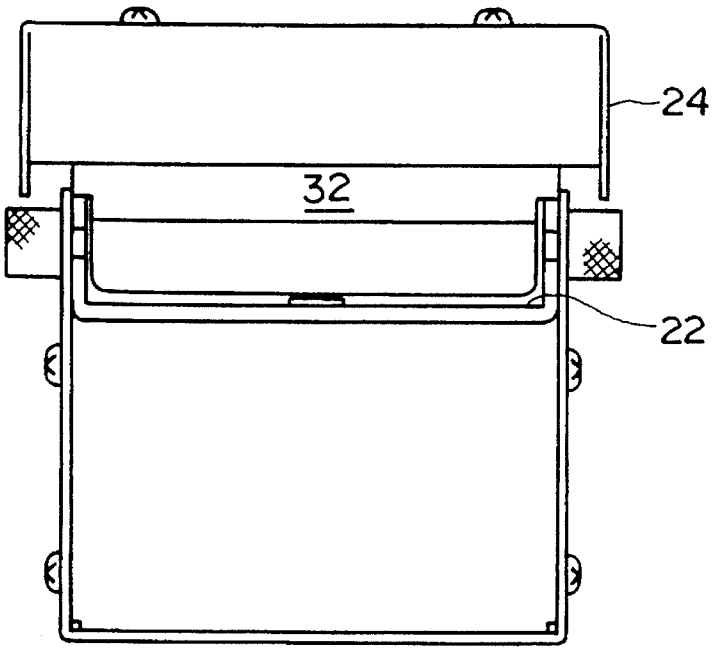
FIG. 11 is a front view of FIG. 8.
Figure 12:
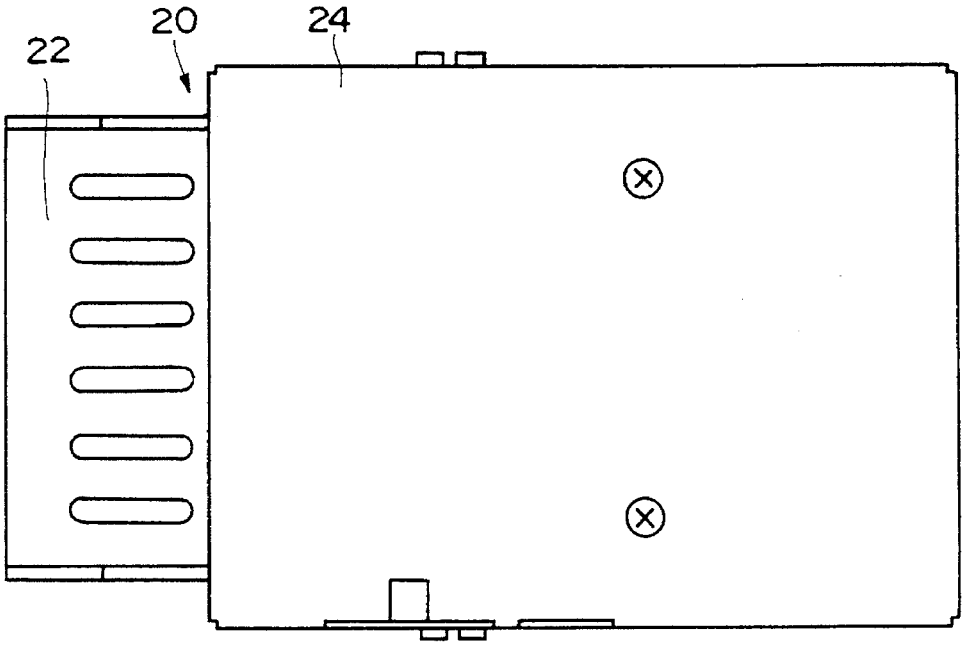
FIG. 12 is a top view of FIG. 8.
Figure 13:
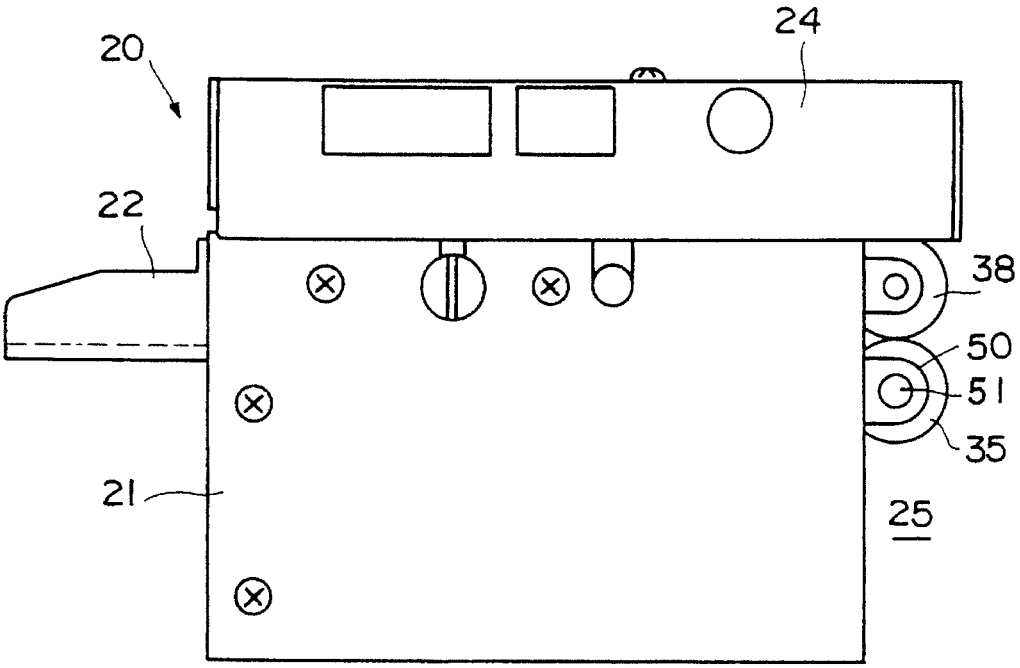
FIG. 13 is a side view of FIG. 8.

Still another embodiment of the present invention is shown in FIGS. 8 to 17. As shown in FIGS. 8 and 9, bending means 28 is provided at the rear end of a conveyor 26 between validator means 24 and stacker means 25. The bending means 28 includes a central guide means 39 for guiding the movement of the lengthwise central portion 23*a* of the bill 23, guide portions 29 for guiding the side edges 23*b* of the bill 23 in parallel to the central portion 23*a* of the bill 23 to the height different from the central portion 23*a* of the bill 23, and blocking edges 31 at the rear ends of the guide portions 29 and extending in directions different from that of the passageway 27 of the central guide means 39. The central guide means 39 has a pulley 35 and a roller 38. The blocking edges 31 of FIG. 9 extend downwardly so that the bill 23 is carried into an inverted V-shape.

Figure 14:
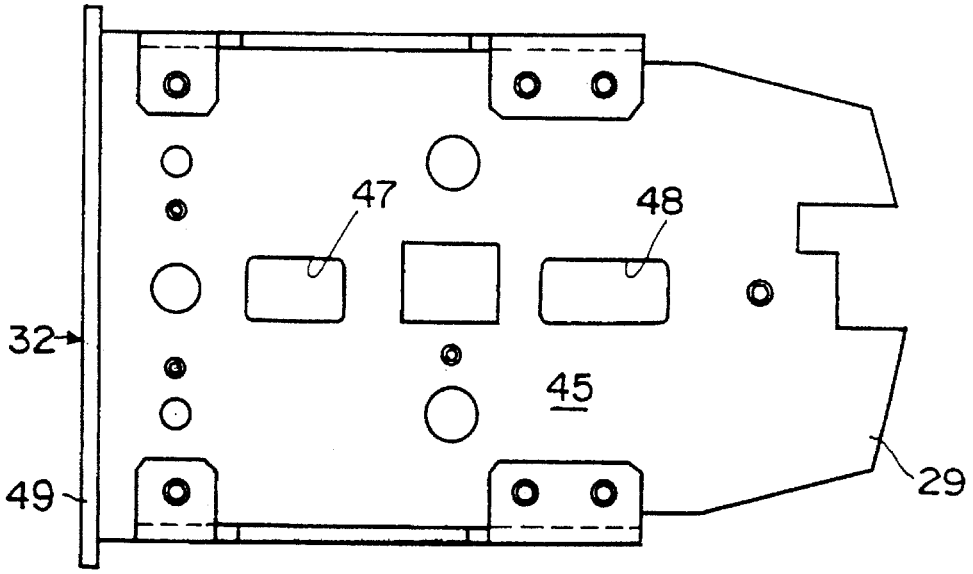
FIG. 14 is a top view of a guide plate.
Figure 15:
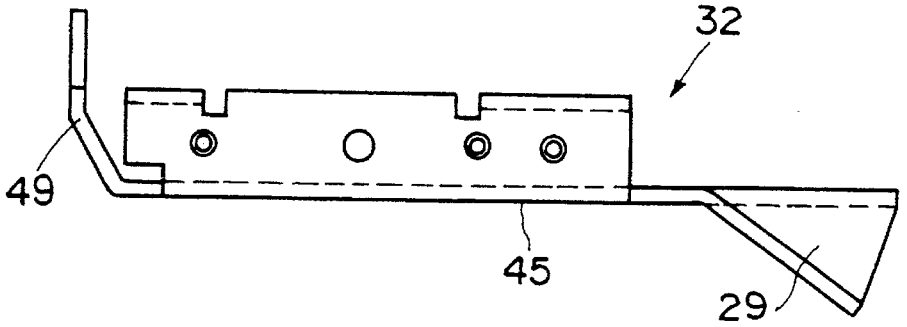
FIG. 15 is a side view of the guide plate.
Figure 16:
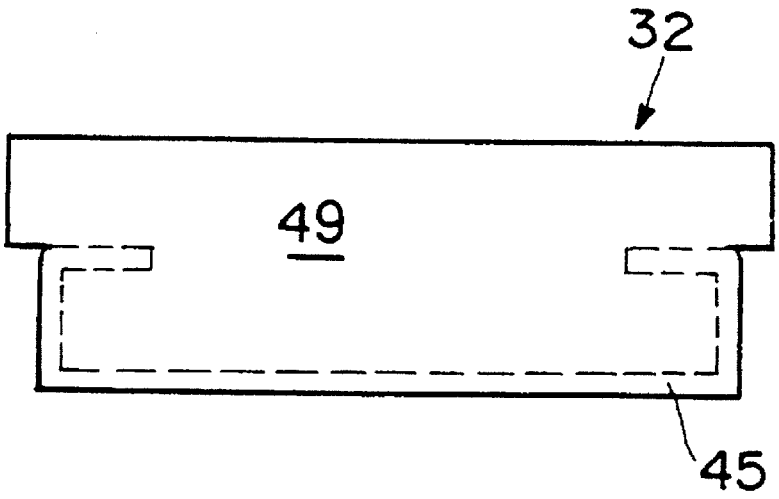
FIG. 16 is a front view of the guide plate.

As shown in FIGS. 14 to 16, a guide plate 32 which provides the upper wall of the passageway 27, comprises a main portion 45 of the guide plate 32, a front wall 49 bent upward at the front portion of the main portion 45, guide portions 29 bent downwardly at the rear portion, and openings 47 and 48 to receive rollers 36 and 37 respectively.

Figure 17:
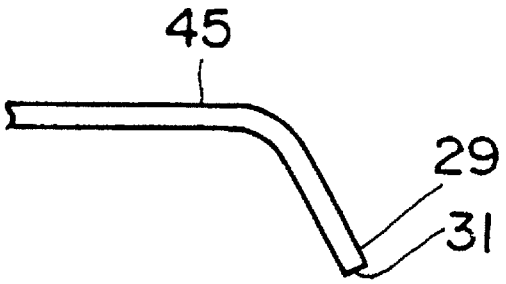
FIG. 17 is a side view of guide portions.
Figure 18:
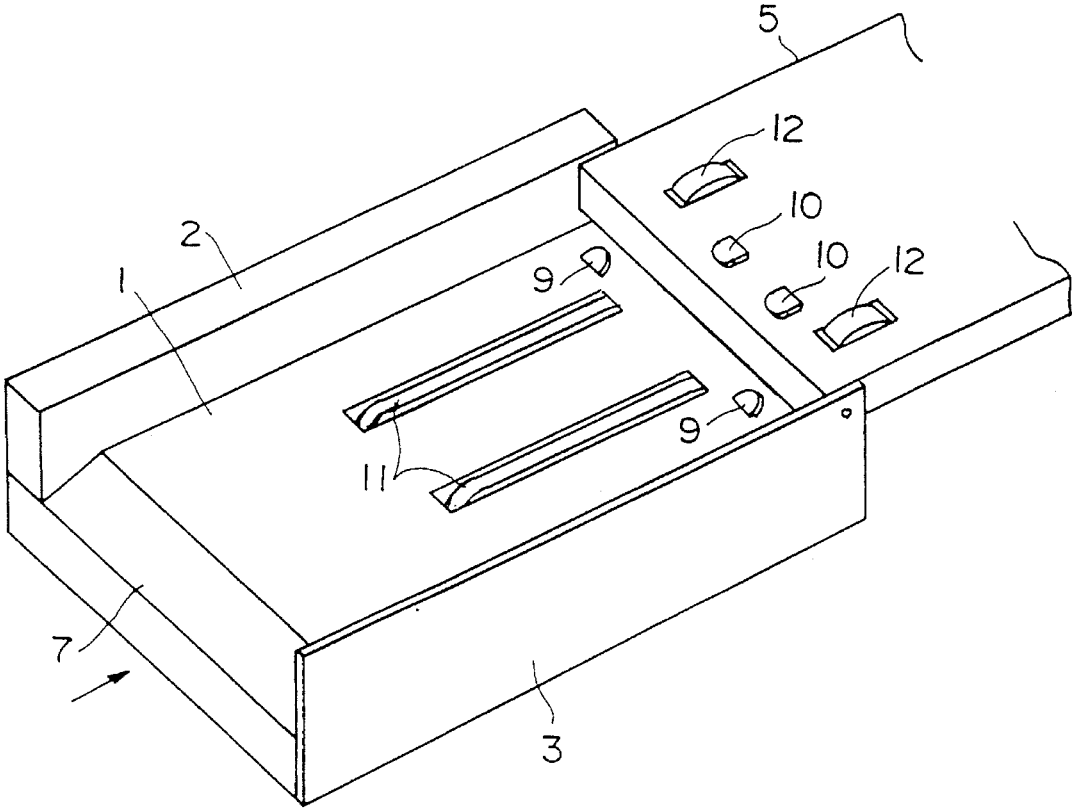
FIG. 18 PRIOR ART
FIG. 18 is a perspective view of a conventional validator.
Figure 19:
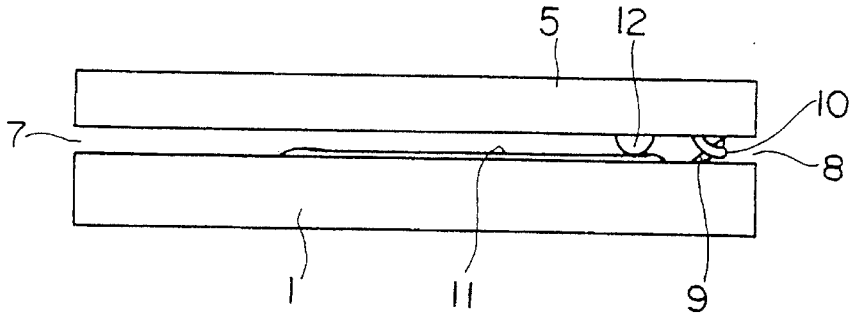
FIG. 19 PRIOR ART
FIG. 19 is a side view of the conventional validator.

As shown in FIG. 17, each guide portion 29 is inclined at an angle of about 45 degrees and the blocking edge 31 is formed at the edge of the guide portion 29. The guide portions 29 and the blocking edges 31 are formed integrally with the metallic main portion 45 of the guide plate 32 and, as shown in FIG. 9, the blocking edges 31 are formed into an inverted-V shape relative to the central guide means 39. The central guide means 39 and the blocking edges 31 extend over the stacker means 25 out of the casing 21 so that the bill 23 is deformed into an inverted-V shape by the bending means 28 with transportation by the conveyor 26. Supplied from the validator means 24 is the bill 23 which then passes through the guide portions 29 in a deformed condition and falls in the stacker means 25 due to its own weight. After that, the bill 23 recovers its initial flat shape due to its own elasticity to form a face intersecting the blocking edges 31.

In the structure described above, the bill 23 passes through the validator means 24 and the bending means 28 by the conveyor 26 and is then conveyed to the stacker means 25. When passing through the bending means 28, the bill 23 is extremely deformed by the guide portions 29 and the central guide means 39 located at substantially the same height as the passageway 27 and then discharged in the stacker means 25. As a result, the bill 23 recovers its initial flat shape due to its own elasticity. Therefore, it is impossible to pull back the bill 23 to the passageway 27 by withdrawing the string attached to the bill 23 because of contact of the bill 23 with the blocking edges 31 or the pulley 35, thus preventing any unauthorized extraction of the bill 23.

The mode of the present invention shown in FIGS. 8 and 9 may be varied. FIG. 9 shows that the blocking edges 31 extend downward to convey the bill in an inverted V-shape, but otherwise, bending means may be designed to have upwardly bent rear portion of the guide plate which forms the lower wall of the passageway 27 so as to carry the bill in a V-shape.

As described above, the present invention makes impossible any unauthorized extraction of a bill out of a bill handling apparatus to firmly prevent the bill handling apparatus from unauthorized access.

I claim:

1. A bill handling apparatus comprising: a casing; an inlet to said casing; validator means for judging authenticity of a bill inserted from said inlet of said casing; stacker means for accumulating the bill considered authentic by said validator means; conveyor means for transporting the bill inserted in the inlet of said casing through said validator means to said stacker means; and bending means provided between said validator means and said stacker means for gradually bending the bill transported from said validator means by said conveyor means; wherein the bill is transported along a passageway defined between a guide plate and a support plate; said bending means comprising: at least a pair of guide portions integrally formed with said guide plate in both sides of said conveyor means, each guide portion extending downward from said guide plate below a bottom surface of the support plate; said conveyor means extending outward over said guide portions for drawing the bill from outside of said guide portions to transport the bill over said guide portions so that both sides of said bill are deformed below the bottom surface of the support plate.

2. The bill handling apparatus of claim 1, wherein a lever is attached to said conveyor means for rotation upon contact with a central portion of said bill which passes through said guide portions.

3. The bill handling apparatus of claim 1, wherein said guide plate includes sides and wherein a plurality of pairs of said guide portions of different heights are formed in both sides of said guide plate.

4. The bill handling apparatus of claim 1, including a plurality of said guide portions longitudinally spaced apart in said guide plate.

5. The bill handling apparatus of claim 1, wherein said conveyor means includes at least a pair of pulleys positioned over said guide portions for drawing the bill from outside of said guide portions to transport the bill over said guide portions.

* * * * *